United States Patent [19]

Waggoner et al.

[11] Patent Number: 4,938,091

[45] Date of Patent: Jul. 3, 1990

[54] THREE FUNCTION CONTROL MECHANISM

[75] Inventors: Van E. Waggoner; Michael E. Barr; Allen F. Loney, all of Dubuque, Iowa

[73] Assignee: Deere & Company, Moline, Ill.

[21] Appl. No.: 449,092

[22] Filed: Dec. 8, 1989

Related U.S. Application Data

[63] Continuation of Ser. No. 263,588, Oct. 26, 1988, abandoned.

[51] Int. Cl.[5] ..... G05G 9/04

[52] U.S. Cl. ..... 74/471 XY; 137/636.2; 180/333

[58] Field of Search ..... 74/471 XY; 137/636.2; 180/333

[56] References Cited

U.S. PATENT DOCUMENTS

| | | | |
|---|---|---|---|
| 3,131,574 | 5/1964 | Clingerman | 74/471 R |
| 3,321,990 | 5/1967 | Densmore | 74/471 R |
| 3,388,609 | 6/1968 | Miller | 74/471 R |
| 4,187,737 | 2/1980 | Mori et al. | 74/471 XY |
| 4,283,964 | 8/1981 | Grattapaglia | 74/471 XY |
| 4,489,805 | 12/1984 | Okabe | 74/471 XY X |
| 4,526,055 | 7/1985 | Batchelor et al. | 74/471 XY |

*Primary Examiner*—Allan D. Herrmann

[57] ABSTRACT

A three-function control lever is provided with a main ball joint operatively coupling the control lever to a console. An operator plate is coupled to the control lever for manipulating a first and second control link for manipulating an first and second hydraulic control valve. The first and second control links are coupled to the operator plate by first and second auxiliary ball joints. A radially extending arm projecting from the control lever controls the positioning of a third link for manipulating a third hydraulic control valve. The third link is coupled to the radially extending arm by a bell crank and auxiliary link. The auxiliary link is operatively coupled to the radially extending arm by a third auxiliary ball joint. A stabilizing link is operatively coupled to the operator plate and a fixed element to preventing the rotation of the operator plate when the control lever is twisted. The centerpoints of the first, second and third auxiliary ball joints and the main ball joint are located in substantially the same plane.

10 Claims, 4 Drawing Sheets

THREE FUNCTION CONTROL MECHANISM

This application is a continuation of application Ser. No. 07/263,588 filed Oct. 26, 1988, now abandoned.

BACKGROUND OF THE INVENTION

1. Field of the Invention:

The invention is directed to a three function control mechanism for controlling the positioning of three separate hydraulic control valves through the manipulation of a single control lever that is operatively mounted to a main ball joint.

2. Description of the Prior Art:

In operating work vehicles, such as crawler dozers, the operator controls a plurality of work operations through manipulating various control levers that control the positioning of hydraulic control valves and thereby the flow of hydraulic fluid to the hydraulic cylinders. It is desirable to control a number of the related operations from a single control lever. Typically three-function control levers have a T-bar shaped control handle that can be moved through two orthogonal control arcs to operate the first two functions and twisted to control a third functions. It is desirable that the control lever can be manipulated to operate each of the functions independently or in unison with the other functions.

Such control three-function control levers are used on crawler dozers manufactured and marketed by the assignee of the present application, for controlling the positioning of the working blade. These control levers are operatively coupled to the machine by a series of universal joints which permit the three-function movement. U.S. Pat. Nos. 3,131,574 and 3,388,609 assigned to the assignee of the present patent application, disclose similar multifunction control lever mechanisms for work vehicles.

A ball joint mounted three-function T-bar control lever has also been proposed in U.S. Pat. No. 4,187,737. In this patent the control lever is secured to a ball socket that is operatively coupled to a ball that is mounted through a stud to the frame of the vehicle. Two of the functions are controlled by moving the control lever through two orthogonal control arcs whereas the third function is controlled by twisting the control lever. In this patent a lost motion coupling is provided to isolate the third function control assembly from interference when the other functions are manipulated by the control lever.

U S. Pat. Nos. 3,321,990, 4,489,805 and 4,526,055 disclose other multifunction control mechanisms for work vehicles.

SUMMARY

It is one of the objects of the present invention to provide a three-function control lever in which each of the control functions can be operated independently of one another, or in unison with one another, or in any combination desired by the operator.

It is another object of the present invention to provide a ball joint mounted three-function control lever that is of a simple design and easy to maintain in the field.

It is another object of the present invention to provide a three-function ball joint mounted control lever that can be easily and readily switched to a two-function control lever.

The present invention comprises a two portion three-function control lever that is operatively coupled to a main ball joint for manipulating the control lever in two orthogonal control arcs and through a twisting motion. The first portion of the control lever is coupled to the main ball joint and an operator plate. The operator plate is provided with three mounting assemblies. The first and second mounting assemblies are coupled to first and second auxiliary ball joints, respectively. The first auxiliary ball joint is provided with a first link that is coupled to a first hydraulic control valve, and the second auxiliary ball joint is operatively coupled to a second link that is coupled to a second hydraulic control valve. A radially extending arm is also mounted to the first portion of the control lever and is provided with a control surface matingly receiving an opposite control surface on the first control lever portion. The arm is also provided with a third mounting assembly to which a third auxiliary ball joint is operatively coupled. A third link is coupled to the third auxiliary ball joint for controlling a third hydraulic control valve. In operation, as the control lever is moved through the two orthogonal control arcs the first and second hydraulic control valves are manipulated through the operator plate, whereas when the control lever is twisted the third hydraulic control valve is manipulated through the radially extending arm.

The operator plate is also provided with a fourth mounting assembly to which is secured one end of a stabilizing link. The other end of the stabilizing link is coupled to a fixed element on the work vehicle . In addition the operator plate is provided with bushings that permit the free rotation of the control lever in the operator plate while the stabilizing link confines the rotational movement of the operator plate.

The second portion of the control lever is secured to the first portion of the control lever above the radially extending arm by a threaded element that engages the threaded end sections of each control lever portion.

To prevent interference and cross over from the controls to the various functions all of the auxiliary ball joints and the main ball joint lie in the same plane.

DETAILED DESCRIPTION

Figure 1:
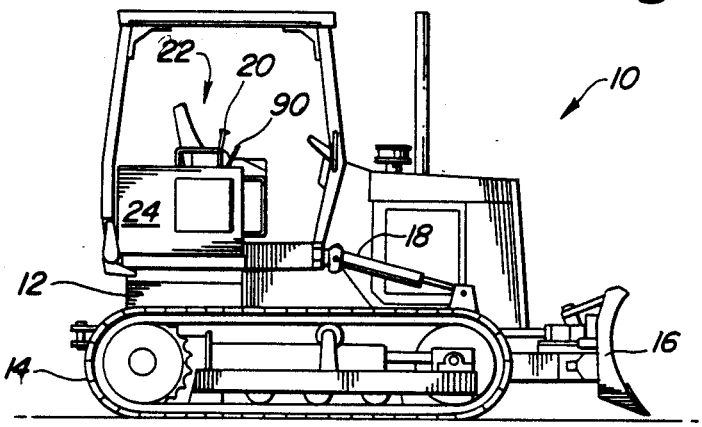
FIG. 1 is a side view of a crawler dozer having a T-bar control lever.

FIG. 1 illustrates a crawler dozer 10 having a supporting structure or frame 12 which is supported and propelled by ground engaging tracks 14. The dozer is provided with working member or blade 16 the position of which is controlled by hydraulic cylinders. More specifically, the blade is raised and lowered by hydraulic cylinder 18 which is controlled by the operator through T-bar control lever 20 located in operators area 22. By manipulating control lever 20 fore and aft the blade is raised and lowered. To tilt the blade about a longitudinal axis, control lever 20 is manipulated left and right which drives another hydraulic cylinder tilting the blade. To angle the blade about a lateral axis the control lever is twisted. Although the control mechanism of the present invention is described as being located on a crawler dozer the invention should not be so limited as it may be applied to other control systems needing single lever three-function control.

Figure 2:
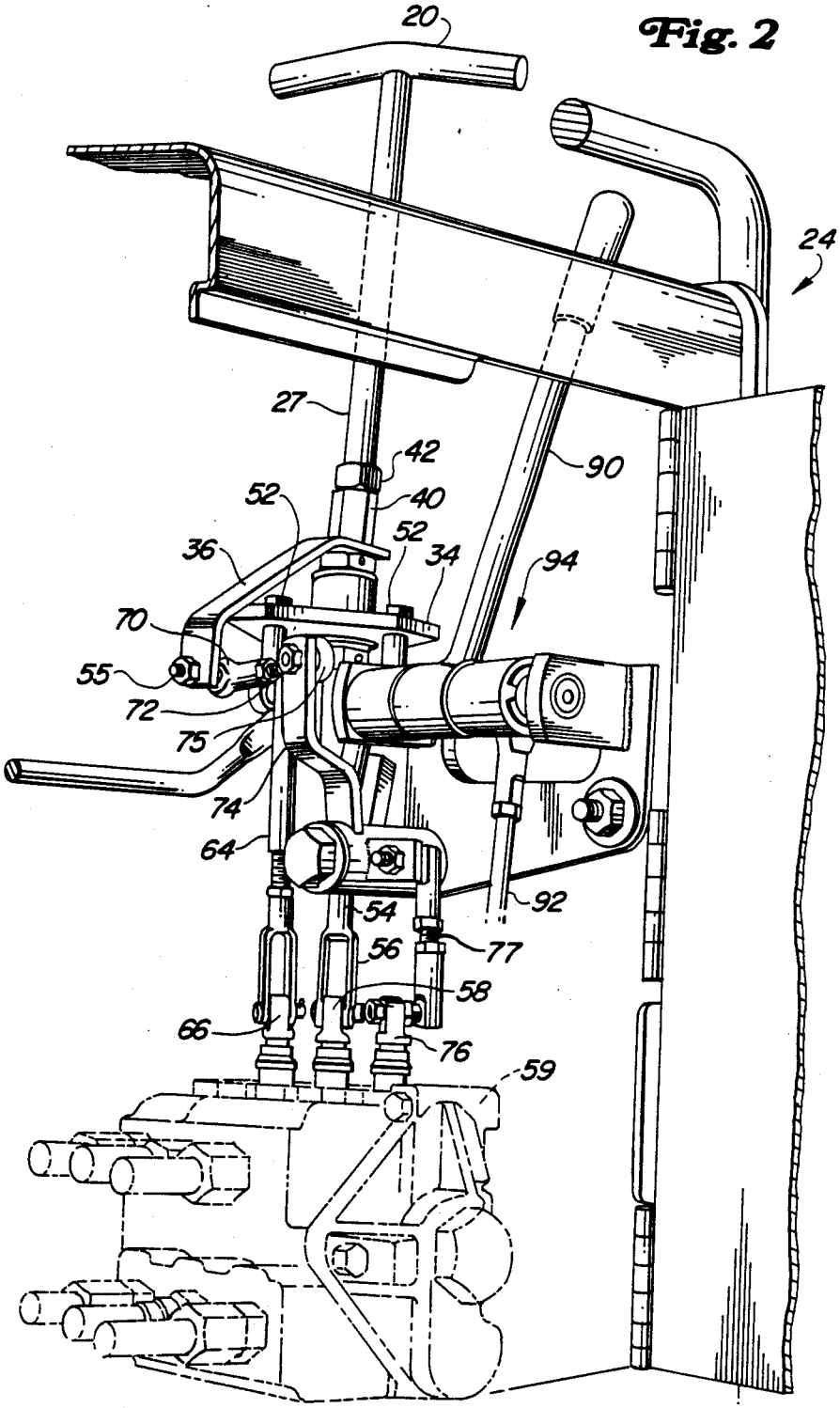
FIG. 2 is a partial cut away view of the control console of the crawler dozer.
Figure 3:
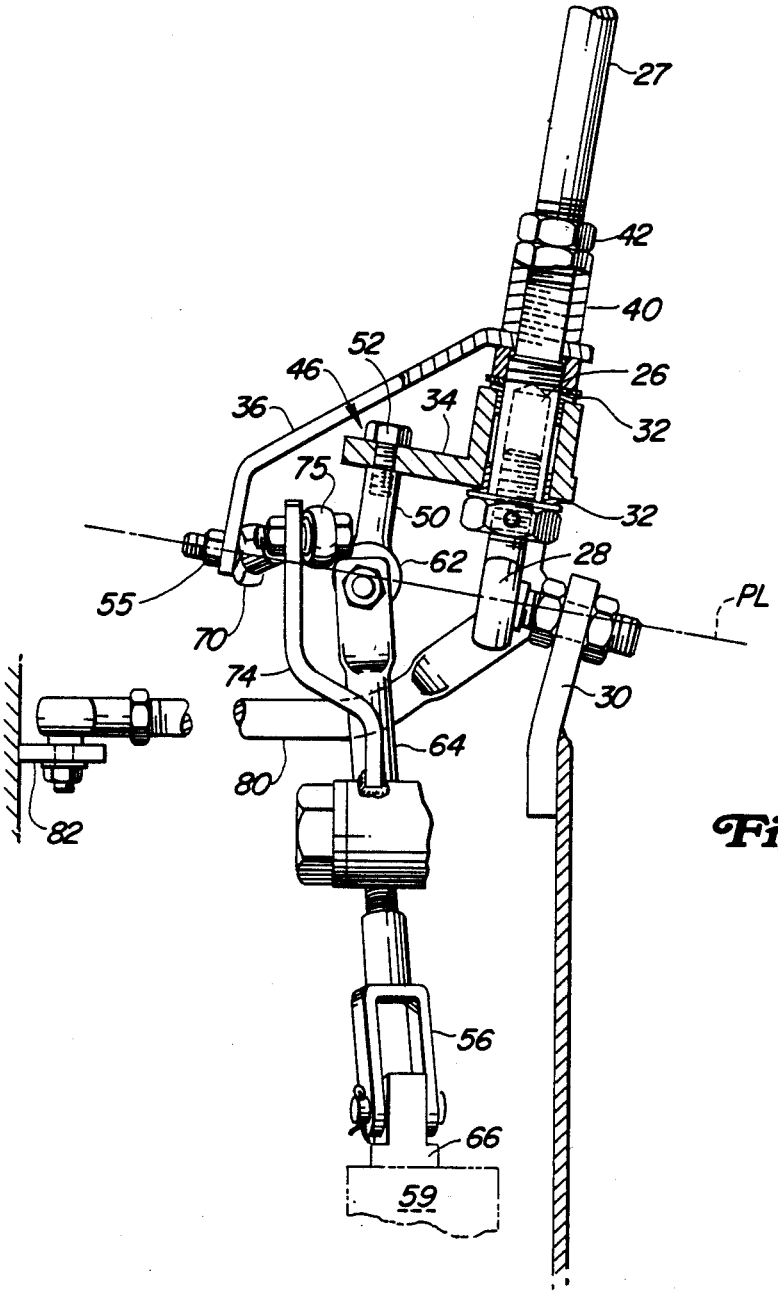
FIG. 3 is a cross sectional view of the control mechanism.
Figure 4:
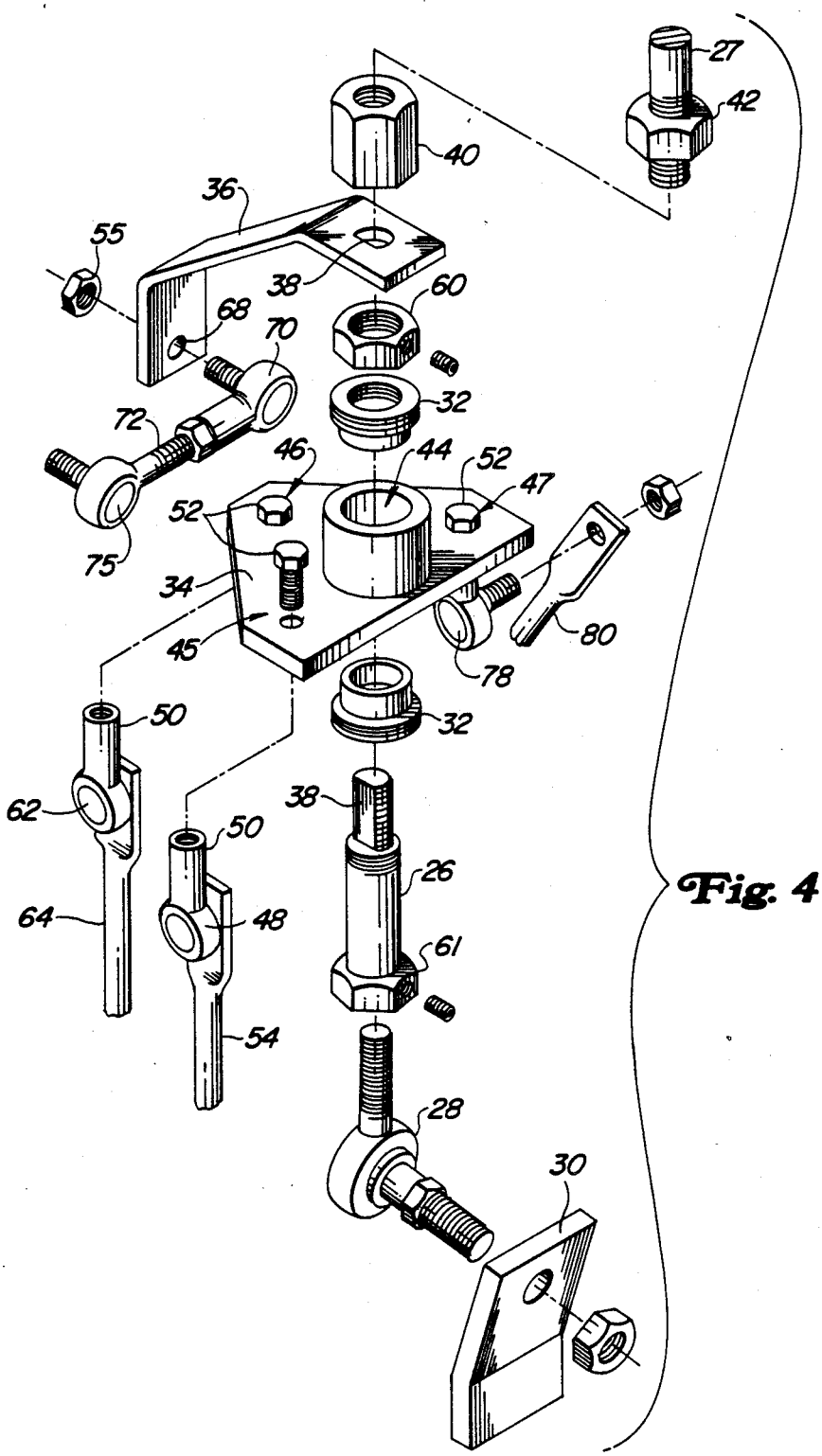
FIG. 4 an exploded view of a portion of the control mechanism.

FIG. 2 is a cut away of the operator's console 24 illustrating a side view of the control mechanism. The control mechanism comprises control lever 20 which is operatively coupled to main tall joint 28 (See FIG. 3 . The control lever has two portions, the first portion 26 and the second portion 27. Main ball joint 28 is mounted to tang 30 which is welded to the interior sidewall of the console. First portion 26 of the control lever extends upwardly through bushing and bearing assemblies 32 of operator plate 34, and through radially extending arm 36. The two bushing and bearing assemblies each comprise a bushing that fits inside main aperture 44 of operator control plate 34 and two thrust washers located outward from the operator plate. The bushing and bearing assemblies 32 permit the control lever to freely rotate relative to operator plate 34. Radially extending arm 36 is operatively coupled to first portion 26 of the control lever by mating control surfaces 38 (See FIG. 4) so that rotation or twisting of the control lever will be transmitted to arm 36. Second portion 27 of the control lever is secured to first portion 26 by threaded member 40 and jam nut 42. Threaded member 40 engages the threaded ends of both first portion 26 and second portion 27 to hold these portions together. Operator plate 34 is sandwiched between bushing and bearing assemblies 32. The bushing and bearing assemblies 32 are held in place between nut 60 and threaded hexagonal portion 61 of first control lever portion 26.

Operator plate 34 is provided with a main aperture 44 for receiving bushings 32 and three smaller apertures forming mounting assemblies 45, 46 and 47. The first mounting assembly 45 is used to mount first auxiliary ball joint 48 to the operator plate. First auxiliary ball joint 48 is provided with a hollow threaded shaft 50 and is held in place on plate 34 by cap screw 52. First auxiliary ball joint 48 is secured to first link 54 by a nut. Link 54 is provided with clevis 56 for securing link 54 to first valve shaft 58 of valve package 59 by a pin and cotterpin.

The second mounting assembly 46 is used to mount the second auxiliary ball joint 62 to the operator plate. The second auxiliary ball joint is identical to the first auxiliary ball joint in that it is provided with a hollow threaded shaft 50 and is held in place by cap screw 52. Similarly the second auxiliary ball joint is provided with second link 64 that is provided with clevis 56 for securing second link 64 to second valve shaft 66 of valve package 59 by a pin and cotterpin.

Radially extending arm 36 is provided with a third mounting assembly 68 comprising an aperture which is used to operatively couple third auxiliary ball joint 70 to the radially extending arm by nut 55. The third auxiliary ball joint is operatively coupled to third link 77 by link 72 which is coupled to bell crank 74 by additional ball joint 75. Bell crank 74 in turn is coupled to third valve shaft 76 of valve package 59 by third link 77.

Fourth mounting assembly 47 is used to mount fourth auxiliary ball joint 78 to the operator plate. The fourth auxiliary ball joint is provided with a stabilizing link 80 which is coupled to a fixed element 82 such as the console sidewall, to prevent rotational movement of the operator plate when the control handle is being twisted. Ball joint 84 operatively couples stabilizing link 80 to fixed element 82.

The hollow threaded shafts of the ball joints and the downward configuration of the radially extending arm locates the centerpoints of the ball joints in substantially the same plane PL as the main ball joint. Such an arrangement is important in that it eliminates interference or cross over when operating the valves independently of one another. It should be noted that instead of elongated ball joint shafts, downwardly depending mounting tabs can be used on the operator plate.

The present control mechanism may be easily changed from a three-function control mechanism to a two-function control mechanism. Such a changeover can be accomplished by removing radially extending arm 36 and third link 72. The system below the radially extending arm remains the same controlling first and second valve shafts 58 and 66. By correctly designing the system, third link 72 can then be used for an auxiliary control lever that is independent of control lever 20.

If a fourth hydraulic control function is required, control lever 90 can be added to the console. Control lever 90 is provided with bell crank 94 which is used to manipulate link 92 that is operatively coupled to a fourth hydraulic valve (not shown). As discussed above, if the third control function is not desired on control lever 20 and radially extending arm 36 and third link 72 are removed from the control mechanism, control link 72 maybe substituted for fourth link 92, thereby reducing the number of parts necessary for alternative control arrangements.

The invention should be not be limited to the above-described embodiment, but should be limited solely to the claims that follow.

We claim:

1. A three-function control mechanism comprising:

a control lever;

a main ball joint to which the control lever is operatively attached for manipulating the control lever through first and second control arcs and also for manipulating the control lever through a twisting motion;

an operator plate having first and second mounting assemblies, the operator plate being operatively coupled to the control lever;

a first auxiliary ball joint mounted to the operator plate by the first mounting assembly, the first auxiliary ball joint being provided with a first link operatively coupling the operator plate to a first hydraulic control valve through the first auxiliary ball joint for controlling a first function;

a second auxiliary ball joint mounted to the operator plate by the second mounting assembly, the second auxiliary ball joint being provided with a second link operatively coupling the operator plate to a second hydraulic control valve through the second auxiliary ball joint for controlling a second function;

a radially extending arm is operatively coupled to the control lever, the arm being provided with a third mounting assembly;

a third auxiliary ball joint is mounted to the arm by the third mounting assembly, the third auxiliary ball joint being provided with a third link operatively coupling the arm to a third hydraulic control valve through the third auxiliary ball joint for controlling a third function, whereby manipulating the control lever in the first and second control arcs manipulates the operator plate and the first and second control links respectively, and twisting the control lever rotates the arm manipulating the third control link.

2. A control mechanism as defined by claim 1 wherein the first, second and third auxiliary balls joints are located in the same plane as the main ball joint.

3. A control mechanism as defined by claim 2 wherein the operator plate is provided with a fourth mounting assembly, a fourth auxiliary ball joint is mounted to the fourth mounting assembly and is provided with a stabilizing link for coupling the operator plate to a fixed element for preventing rotation of the operator plate when the control lever is twisted, the operator plate further being provided with bushings in which the control lever is free to rotate.

4. A control mechanism as defined by claim 3 wherein the third link is provided with a bell crank and a fourth link to operatively couple the third link to a third hydraulic control valve.

5. A control mechanism as defined by claim 4 wherein the control lever and the arm are both provided with mating control surfaces for transmitting twisting motion between the control lever and the arm.

6. A work vehicle for performing a work operation, the vehicle comprising:

a supporting frame;

ground engaging means for supporting and propelling the supporting structure;

a working member for performing a work operation is operatively coupled to the vehicle;

means for manipulating the working member is mounted on the work vehicle; and a three function control mechanism for controlling the means for manipulating the working member, the control mechanism having a control lever, a main ball joint to which the control lever is operatively attached for manipulating the control lever through first and second control arcs and also for manipulating the control lever through a twisting motion, an operator plate having first and second mounting assemblies, the operator plate being operatively coupled to the control lever, a first auxiliary ball joint mounted to the operator plate by the first mounting assembly, the first auxiliary ball joint being provided with a first link operatively coupling the operator plate to a first hydraulic control valve through the first auxiliary ball joint for controlling a first function, a second auxiliary ball joint mounted to the operator plate by the second mounting assembly, the second auxiliary ball joint being provided with a second link operatively coupling the operator plate to a second hydraulic control valve through the second auxiliary ball joint for controlling a second function, a radially extending arm is operatively coupled to the control lever, the arm being provided with a third mounting assembly, a third auxiliary ball joint is mounted to the arm by the third mounting assembly, the third auxiliary ball joint being provided with a third link operatively coupling the arm to a third hydraulic control valve through the third auxiliary ball joint for controlling a third function, whereby manipulating the control lever in the first and second control arcs manipulates the operator plate and the first and second control links respectively, and twisting the control lever rotates the arm manipulating the third control link.

7. A work vehicle as defined by claim 6 wherein the first, second and third auxiliary balls joints are located in the same plane as the main ball joint.

8. A work vehicle as defined by claim 7 wherein the operator plate is provided with a fourth mounting assembly, a fourth auxiliary ball joint is mounted to the fourth mounting assembly and is provided with a stabilizing link for coupling the operator plate to a fixed element for preventing rotation of the operator plate when the control lever is twisted, the operator plate further being provided with bushings in which the control lever is free to rotate.

9. A work vehicle as defined by claim 8 wherein the third link is provided with a bell crank and a fourth link to operatively couple the third link to a third hydraulic control valve.

10. A work vehicle as defined by claim 9 wherein the control lever and the arm are both provided with mating control surfaces for transmitting twisting motion between the control lever and the arm.

* * * * *